United States Patent [19]

Hunt et al.

[11] 4,211,499

[45] Jul. 8, 1980

[54] PAPER FEEDING CONTROL APPARATUS

[75] Inventors: Ronald E. Hunt; Ernest G. Souliere, both of Austin, Tex.

[73] Assignee: International Business Machines Corporation, Armonk, N.Y.

[21] Appl. No.: 973,360

[22] Filed: Dec. 26, 1978

[51] Int. Cl.[3] ..... B41J 13/02

[52] U.S. Cl. ..... 400/637.6; 400/639.1; 400/663

[58] Field of Search ..... 400/636, 636.1, 636.2, 400/630, 631, 637.1, 637.2, 637.4, 637.5, 637.6, 639.1, 639.2, 645, 647.1, 663, 670.3

[56] References Cited

U.S. PATENT DOCUMENTS

| | | | |
|---|---|---|---|
| 1,145,017 | 7/1915 | Hess | 400/637.2 X |
| 1,874,256 | 8/1932 | Dobson | 400/637.3 X |
| 1,969,773 | 8/1934 | Avery | 400/637.2 |
| 2,864,484 | 12/1958 | Metzner | 400/636.2 X |
| 2,881,893 | 4/1959 | Metzner | 400/637.2 X |
| 3,223,221 | 12/1965 | Arthur | 400/639.1 X |
| 4,090,410 | 5/1978 | Nakamura | 400/636 X |

OTHER PUBLICATIONS

"Antitreeing Device for Paper Feed Mechanisms," IBM Tech. Discl. Bulletin, vol. 15, No. 7, Dec. 1972, p. 2311.

"Paper Feed," IBM Tech. Discl. Bulletin, vol. 18, No. 5, Oct. 1975, pp. 1305–1306.

"Document Entry Mechanism for Typewriter Paper Handler," IBM Tech. Discl. Bulletin, vol. 21, No. 2, Jul. 1978, pp. 709–710.

"Paper Table Actuated Feed Rollers & Paper Gate," IBM Tech. Discl. Bulletin, vol. 17, No. 5, Oct. 1974, pp. 1263–1264.

*Primary Examiner*—Eugene H. Eickholt

*Attorney, Agent, or Firm*—James H. Barksdale, Jr.

[57] ABSTRACT

Apparatus for controlling the feeding of paper about a printer platen. Controlled are paper aligning, rear roller feeding, front roller feeding and paper bail operation. The apparatus is primarily made up of a rocker button, reed switches, a drive motor, a cam gear, a comb, and a paper bail. Upon operator manipulation of the rocker button, the drive motor is turned on for rotating the cam gear. Rotation of the cam gear effects bi-directional rotation of the comb and a paper bail arm carrying the paper bail. Rotation of the comb in a first direction results in (1) a rear feed roller being displaced from the platen to provide a feeding path for paper when inserted into the printer, and (2) a paper aligner being positioned for aligning the paper. Rotation of the comb in a second direction results in the rear feed roller causing engagement of the paper and platen and the paper aligner being brought out of the feeding path of the paper. Rotation of the paper bail arm in a first direction causes the paper bail to be displaced from the platen. Rotation in a second direction results in the paper bail causing engagement of the paper and platen.

10 Claims, 8 Drawing Figures

SHT 2 OF 2
AT9-78-009

PAPER FEEDING CONTROL APPARATUS

DESCRIPTION

Cross-Reference to Related Application

U.S. patent application Ser. No. 973,361, filed Dec. 26, 1978, entitled "Paper Feeding Apparatus," and having A. B. Habich et al. as inventors.

BACKGROUND OF THE INVENTION

1. Field of the Invention

This invention relates generally to printer paper handling. More specifically, this invention relates to apparatus for controlling paper aligning, rear roller feeding, front roller feeding, and paper bail opening and closing.

2. Description of the Prior Art

Representative of typical prior art related to this invention are IBM Technical Disclosure Bulletins Vol. 15, No. 7, December 1972, page 2311; Vol. 17, No. 5, October 1974, pages 1263 and 1264; Vol. 18, No. 5, October 1975, pages 1305 and 1306; and Vol. 21, No. 2, July 1978, pages 709 and 710.

Illustrated in various ones of these prior art publications are the general features of front and rear roller feeding, paper aligning, and paper bail opening and closing. Each of these features taken alone, or in combination, is old and well known. In fact, the above mentioned October 1974 publication discloses all of the general features of this application including partial control by a single means.

As far as specific control structure is concerned though, there is no similarity between the apparatus of this invention and that disclosed in the 1974 publication. In addition, the device to be operated by the control structure is different than that disclosed in the publication.

SUMMARY OF THE INVENTION

Apparatus is provided for controlling paper aligning, rear roller feeding, front roller feeding and paper bail opening and closing in conjunction with the feeding of paper about a printer platen. The apparatus is primarily made up of an operator manipulatable rocker button, reed switches, a drive motor, a cam gear, a comb, and a paper bail arm for carrying a paper bail. When each of these components is in a position or state for paper to be loaded into the printer, the operator procedure is to insert a sheet of paper into the printer from behind the platen and align the leading edge of the sheet relative to a paper aligner. At this time, (1) a rear feed roller is located away from the platen to provide a paper path to the paper aligner, (2) the paper aligner is located in the path of the leading edge of the sheet, and (3) the paper bail is closed or located against the platen. Thereafter, momentary depression of the rocker button to a start position initiates a controlled operation of feeding paper about the platen to a first writing line position. Upon depression of the button, one of the reed switches is tripped by the rocker button and the drive motor is started. The drive motor is connected to the cam gear which effects rotation of the comb and the paper bail arm in a first direction. Rotation of the comb in the first direction causes the rear feed roller to be translated toward the platen and the paper aligner to be repositioned out of the path of the paper. Translation of the rear feed roller toward the platen is to effect engagement of the platen and paper for feeding the paper about the platen upon rotation of the platen. Repositioning of the paper aligner is to open the paper path about the platen. Rotation of the paper bail arm in a first direction results in a paper bail carried by the arm to be translated away from the platen.

Carried by the cam gear is a magnet which will eventually trip another reed switch upon continued rotation of the cam gear. When this occurs, the drive motor is turned off, and the platen is rotated for advancing the leading edge of the paper beyond the paper aligner and a front feed roller to a first writing line position adjacent the paper bail. After the paper has been advanced to this extent, rotation of the platen is stopped and the drive motor is again turned on. This results in further rotation of the cam gear. During this further rotation, the comb is rotated in a second direction for translating the front feed roller toward the paper and causing engagement of the paper with the platen. Also, the paper aligner is permitted to restore and again engage the paper. Following this, the paper bail arm is rotated in a second direction for bringing the leading end of the sheet toward and against the platen for printing on the sheet.

DESCRIPTION OF THE PREFERRED EMBODIMENT

The apparatus for facilitating paper feeding described and claimed in the above cross-referenced application is to be cont-olled by the apparatus of this invention. To the extent necessary for a complete understanding of this invention, the apparatus of the above cross-referenced application will also be described herein.

Structural Description

Figure 1A:
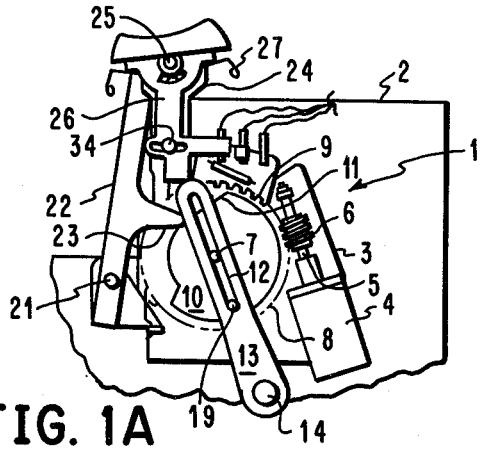
FIG. 1A is an end view of the control apparatus of this invention with the components thereof positioned or in a state for a paper release function.
Figure 1B:
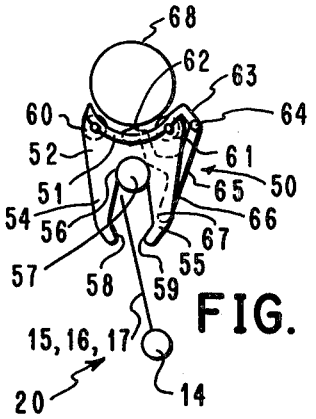
FIG. 1B is an end view illustrating the position of the comb portion of the control apparatus of this invention for the component position or state shown in FIG. 1A.
Figure 4:
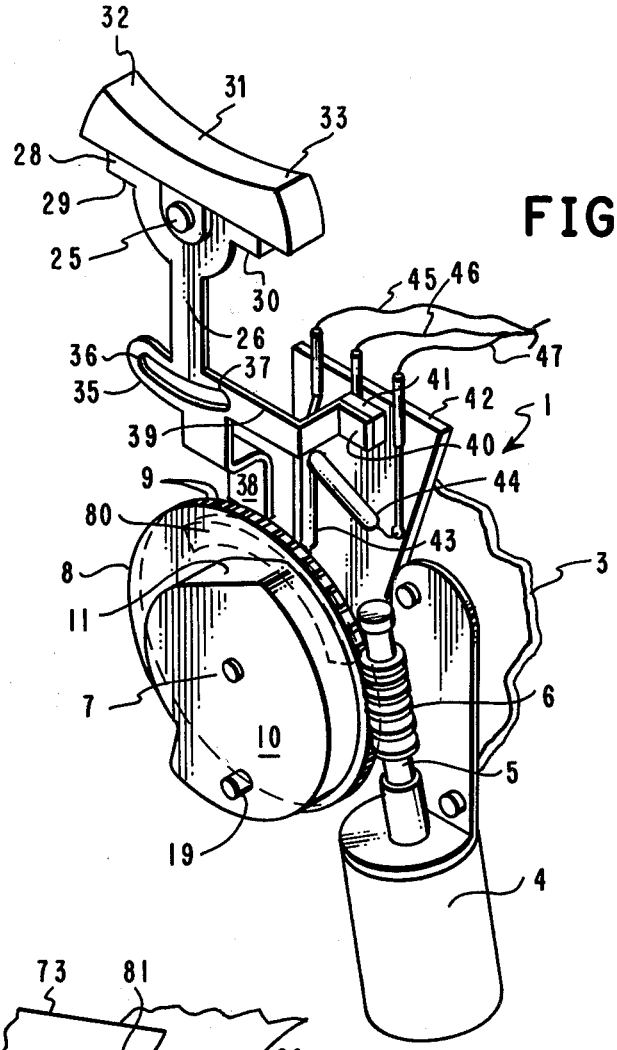
FIG. 4 is a perspective view of the apparatus shown in FIGS. 1A, 2A, and 3A, illustrating the components thereof in greater detail.

Refer to FIGS. 1A, 1B, and 4. The control apparatus of this invention is made up of a modular unit generally designated by reference numeral 1 in FIG. 1A and a comb generally designated by reference numeral 20 in FIG. 1B. Unit 1 is connected to one end of a printer frame 2 and is substantially totally carried by an irregular shaped support frame 3. Mounted on support 3 is the drive motor 4 having a drive shaft 5. Connected to shaft 5 is a worm gear 6. Carried by support 3 is a shaft 7. Rotatable upon shaft 7 is a cam gear 8. Cam gear 8 has teeth 9 about the periphery thereof which are in engagement with worm gear 6. On the front face of cam gear 8 is a protruding cam lobe 10 having a paper bail cam surface 11. Connected to lobe 10 adjacent the outer periphery of cam gear 8 is an outwardly extending shaft 19. Shaft 19 is for communicating with an elongated slot 12 in a comb arm 13. The lower end of comb arm 13 is secured a rod 14 which rotatably extends through printer frame 2. Rod 14 forms part of comb 20 which has teeth 15, 16, 17, etc.

Figure 5:
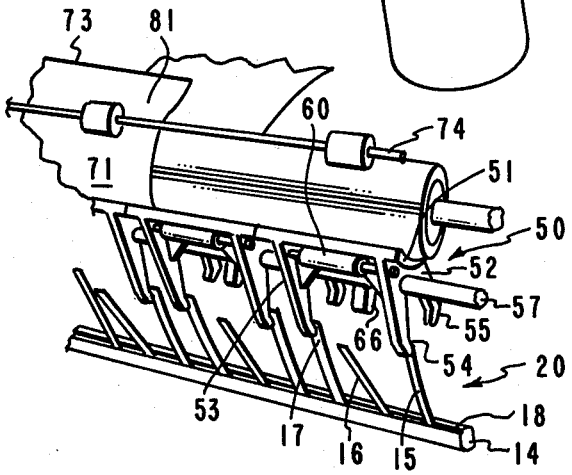
FIG. 5 is a perspective view of the apparatus shown in FIGS. 1B, 2B, and 3B illustrating the components thereof in greater detail.

Referring for a moment to FIG. 5, there are shown the details of comb or comb spring 20. Rod 14 has an elongated slot 18 therein. Within slot 18 is secured a serrated leaf spring having radially extending tines which form teeth 15, 16, 17, etc.

Refer again to FIGS. 1A, 1B, and 4. Carried by printer frame 2 is an outwardly extending shaft 21. Rotatable on shaft 21 is a paper bail arm 22 having a follower leg 23. The end of follower leg 23 cooperates with cam surface 11 upon rotation of cam gear 8 for rotation of paper bail arm 22 in a first and a second direction. Arm 22 and shaft 21 are not carried by frame 3.

Connected to the upper portion 24 of support 3 is an outwardly extending shaft 25. Carried by shaft 25 are a rocker button arm 26 and a restore spring 27. Integral with the upper portion of arm 26 is a rocker button support 28 having contact surfaces 29 and 30. Connected to the top of support 29 is a rocker button 31. Upon an operator depressing either of ends 32 or 33 of rocker button 31, arm 26 is rotated about shaft 25. Spring 27 will be contacted by one of surfaces 29 and 30 depending upon the ends 32 or 33 depressed by the operator. Upon the operator releasing or no longer applying pressure to one of ends 32 and 33, spring 27 will cause rocker button 31 and arm 26 to restore to the position shown.

Also carried by support 3 is an outwardly extending shaft 34. Shaft 34 is for communicating with an elongated arcuate slot 35 in arm 26. Slot 35 is located below shaft 25. Ends 36 and 37 of slot 35 will limit the extent of rock or rotation of control button 31 and arm 26. Integral with arm 26 are a shunt leg 38 and a magnet leg 39. Connected to the outer end 40 of magnet leg 39 is a magnet 41.

Also carried by support 3 is a reed card 42. Supported on reed card 42 are reed switches 43 and 44. Reed switches 43 and 44 are connected to input/output leads 45, 46, and 47. As will be appreciated hereinafter, signals are applied along a number of leads 45, 46, and 47 to turn motor 4 on and off, and to turn a platen drive motor (not shown) on and off. Motor 4 and the platen drive motor are to be operated at different times.

Imbedded in the back face of gear 8 is an arcuate shaped magnet 80 which is positionable upon rotation of gear 8 relative to reed switch 43 for causing motor 4 to be turned off and the platen drive motor to be turned on.

Refer next to FIGS. 1B and 5. Comb 20 is for cooperating with the apparatus described and claimed in the above cross-referenced application. The apparatus of the referenced application is generally designated by reference numeral 50. Apparatus 50 is made up of a platen channel 51 and yokes 52 and 53. Since yokes 52 and 53 are identical, only yoke 52 will be described. Yoke 52 is integral with channel 51 and has downwardly extending legs 54 and 55 with a detent 56 therebetween. Detent 56 is for accepting a shaft 57, the ends of which are connected to printer frame 2. Apparatus 50 is rotatable about shaft 57 by comb 20 upon tooth 15 contacting surfaces 58 and 59 of legs 54 and 55.

Channel 51 has three openings therein. Through one of the openings extends a front feed roller 60, and through another opening extends a rear feed roller 61. A paper aligner 62 is positionable within the third opening in channel 51. Connected to channel 51 is a downwardly extending stud 63 carrying a shaft 64. Rotatably connected to shaft 64 is an aligner crank 65. Aligner 62 is connected to crank 65. Crank 65 has a downwardly extending leg 66 with a contact surface 67. Contact surface 67 is contacted by tooth 16 for positioning aligner 62 relative to a printer platen 68.

Operational Description

Figure 2A:
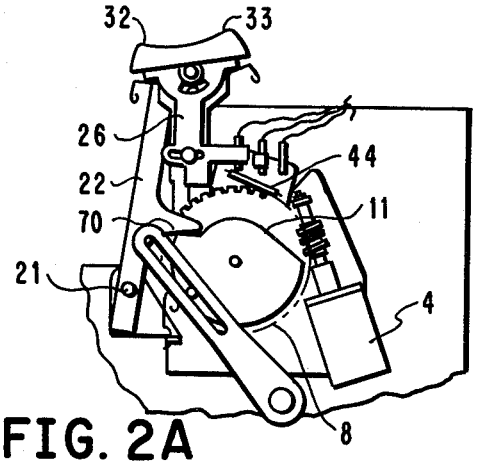
FIG. 2A is another end view of the control apparatus with the components thereof positioned or in a state for an initial paper insertion operation.
Figure 2B:
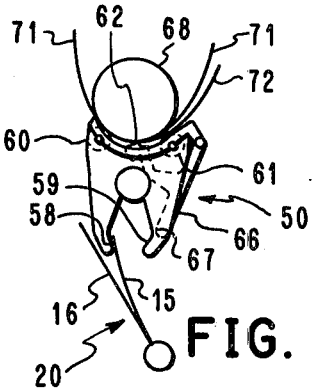
FIG. 2B is an end view illustrating the position of the comb for the component position or state shown in FIG. 2A.

Refer next to FIGS. 2A, 2B, and 5. During actual printing operations, front feed roller 60 is located such that it is causing engagement of paper 71 and platen 68. In order for roller 60 to be in this position comb 20 must have been rotated in a counterclockwise direction and tooth 15 must be acting against surface 58. With tooth 15 acting against surface 58, apparatus 50 is maintained in the position shown in FIG. 2B. At this time, aligner 62 is in contact with paper 71 and urging it against platen 68. At any time after sheet 71 has been advanced to the first writing line, a subsequent sheet 72 can be inserted into the printer from behind platen 68.

There are three extents of rotation of comb 20 in each of the forward (counterclockwise) and reverse (clockwise) directions. With comb 20 positioned as shown in FIG. 2B, the first extent of reverse rotation permits front feed roller 60 to be translated away from platen 68. That is, roller 60 is released. This is due to tooth 15 being brought out of contact with surface 58. The second extent of reverse rotation is for causing tooth 15 to contact surface 59 and cause rotation of apparatus 50 in a counterclockwise direction. When this occurs, rear feed roller 61 is translated toward platen 68 for causing engagement of paper 71 and platen 68. The third extent of reverse rotation of comb 20 results in tooth 16 contacting surface 67 of crank leg 66 for translating aligner 62 away from platen 68.

The first extent of forward rotation of comb 20 from the third extent of reverse rotation of comb 20 results in tooth 16 being brought out of contact with surface 67. When this occurs, aligner 62 is released or permitted to be translated toward platen 68 under the influence of a spring (not shown). The second extent of forward rotation of comb 20 results in tooth 15 being brought out of contact with surface 59. This permits roller 61 to be translated away from platen 68. That is, roller 61 is released. The third extent of forward rotation of comb 20 results in tooth 15 contacting surface 58 for translating front feed roller 60 toward platen 68. This is for causing engagement of paper 71 and platen 68.

Prior to an initial loading operation wherein a sheet of paper 71 is to be inserted into a printer from behind platen 68, rear feed roller 61 is positioned away from platen 68 and aligner 62 is in contact with platen 68. This provides a path between roller 61 and platen 68 for leading edge 73 of sheet 71. Upon insertion of paper 71 between roller 61 and platen 68, leading edge 73 is abutted against aligner 62 for aligning sheet 71. Following alignment of leading edge 73 against aligner 62, aligner 62 is to be translated away from platen 68 to provide a continued path for paper 71 about platen 68. Also, rear feed roller 61 is to be translated toward platen 68 for causing engagement of sheet 71 with platen 68. Thereafter, platen 68 is rotated until leading edge 73 extends beyond front feed roller 60 and paper 71 is positioned at a first writing line position for printing. After paper 71 has been advanced to this extent, aligner 62 is translated toward platen 68 for holding sheet 71 aligned in place while rear feed roller 61 is translated away from platen 68 and front feed roller 60 is translated toward platen 68. Translation of front feed roller 60 toward platen 68 is for causing engagement of sheet 71 and platen 68 for feeding sheet 71 during printing.

With the above in mind, the following two tables are provided to more clearly illustrate operation of this invention and the relationship of the apparatus of this invention to the apparatus of the above cross-referenced application. The first table A relates to a paper loading operation which begins with paper insertion and terminates with the inserted paper being positioned at a first writing line position for printing. The second table B relates to a paper release operation wherein the inserted paper is to be released from engagement with the platen for operator adjustment or removal from the printer.

TABLE A

| | A<br>EVENTS | B<br>END OF BUTTON 31 DEPRESSED | C<br>DIRECTION OF ROTATION OF COMB 20 | D<br>EXTENT OF ROTATION OF COMB 20 |
|---|---|---|---|---|
| I | LEADING EDGE 73 INSERTED INTO PRINTER (1) | NEITHER | COMB 20 AT REST, TOOTH 15 ENGAGED WITH SURFACE 58 | FORWARD 3RD EXTENT |
| II | PAPER 71 TO BE FED ABOUT PLATEN 68 | 33 (2) | REVERSE (5) | FORWARD 3RD EXTENT |
| III | | NEITHER (7) | REVERSE | REVERSE 1ST EXTENT (6) |
| IV | | NEITHER | REVERSE | REVERSE 2ND EXTENT (10) |
| V | | NEITHER | REVERSE | REVERSE 3RD EXTENT (11) |
| VI | | NEITHER | FORWARD (17) | FORWARD 1ST EXTENT (17) |
| VII | | NEITHER | FORWARD | FORWARD 2ND EXTENT (19) |
| VIII | | NEITHER | FORWARD | FORWARD 3RD EXTENT (23) |

| | E<br>RELATIONSHIP OF PAPER ALIGNER 62 AND PLATEN 68 | F<br>STATE OF PLATEN 68 | G<br>STATE OF REED SWITCH 43 | H<br>STATE OF REED SWITCH 44 |
|---|---|---|---|---|
| I | ENGAGED | STOPPED | CLOSED | OPEN |
| II | ENGAGED | STOPPED | CLOSED | CLOSED (3) |
| III | ENGAGED | STOPPED | CLOSED | OPEN (8) |
| IV | ENGAGED | STOPPED | CLOSED | OPEN |
| V | DISENGAGED (11) | ROTATED (14) | OPENED (12) | OPEN |
| VI | ENGAGED (17) | STOPPED (15) | OPENED | OPEN |
| VII | ENGAGED | STOPPED | OPENED | OPEN |
| VIII | ENGAGED | STOPPED | CLOSED (21) | OPEN |

| | I<br>DRIVE MOTOR 4 | J<br>PAPER BAIL 74 | K<br>RELATIONSHIP OF FRONT FEED ROLLER 60 TO PLATEN 68 | L<br>RELATIONSHIP OF REAR FEED ROLLER 61 TO PLATEN 68 |
|---|---|---|---|---|
| I | OFF | CLOSED | ENGAGED | DISENGAGED |
| II | ON (4) | CLOSED | ENGAGED | DISENGAGED |
| III | ON | CLOSED | RELEASED | RELEASED |

TABLE A-continued

| | | | | |
|---|---|---|---|---|
| | | | (6) | (6) |
| IV | ON | OPEN (9) | DISENGAGED (10) | ENGAGED (10) |
| V | OFF (13) | OPEN | DISENGAGED | ENGAGED |
| VI | ON (16) | OPEN | DISENGAGED | ENGAGED |
| VII | ON | OPEN | RELEASED (19) | RELEASED (19) |
| VIII | OFF (22) | CLOSED (20) | ENGAGED (23) | DISENGAGED (23) |

TABLE B

| | A EVENTS | B END OF BUTTON 31 DEPRESSED | C DIRECTION OF ROTATION OF COMB 20 | D EXTENT OF ROTATION OF COMB 20 |
|---|---|---|---|---|
| I | PAPER 71 ABOUT PLATEN 68 PRIOR TO RELEASE OPERATION (1) | NEITHER | COMB 20 AT REST WITH TOOTH 15 ENGAGED WITH SURFACE 58 | FORWARD 3RD EXTENT |
| II | PAPER TO BE RELEASED | 32 (2) | REVERSE (5) | FORWARD 3RD EXTENT |
| III | | NEITHER (8) | STOPPED (7) | REVERSE 1ST EXTENT (7) |
| IV | RECLAMP PAPER FROM PAPER RELEASE | 33 (10) | REVERSE (13) | REVERSE 1ST EXTENT |
| V | | NEITHER (16) | REVERSE | REVERSE 2ND EXTENT (15) |
| VI | | NEITHER | REVERSE | REVERSE 3RD EXTENT (18) |
| VII | | NEITHER | FORWARD (19) | FORWARD 1ST EXTENT (19) |
| VIII | | NEITHER | FORWARD | FORWARD 2ND EXTENT (20) |
| IX | | NEITHER | FORWARD | FORWARD 3RD EXTENT (22) |

| | E RELATIONSHIP OF PAPER ALIGNER 62 AND PLATEN 68 | F STATE OF PLATEN 68 | G STATE OF REED SWITCH 43 | H STATE OF REED SWITCH 44 |
|---|---|---|---|---|
| I | ENGAGED | STOPPED | CLOSED | OPEN |
| II | ENGAGED | STOPPED | SHUNTED OPEN (3) | OPEN |
| III | ENGAGED | STOPPED | CLOSED (9) | OPEN |
| IV | ENGAGED | STOPPED | CLOSED | CLOSED (11) |
| V | ENGAGED | STOPPED | CLOSED | OPEN (17) |
| VI | DISENGAGED (18) | STOPPED | OPEN (18) | OPEN |
| VII | ENGAGED (19) | STOPPED | OPEN | OPEN |
| VIII | ENGAGED | STOPPED | OPEN | OPEN |
| IX | ENGAGED | STOPPED | CLOSED (22) | OPEN |

| | I | J | K RELATIONSHIP OF FRONT FEED | L RELATIONSHIP OF REAR FEED |
|---|---|---|---|---|

TABLE B-continued

| | DRIVE MOTOR 4 | PAPER BAIL 74 | ROLLER 60 TO PLATEN 68 | ROLLER 61 TO PLATEN 68 |
|---|---|---|---|---|
| I | OFF | CLOSED | ENGAGED | DISENGAGED |
| II | ON TIME OUT (4) | CLOSED | ENGAGED | DISENGAGED |
| III | OFF (6) | CLOSED | RELEASED (7) | RELEASED (7) |
| IV | ON (12) | CLOSED | RELEASED | RELEASED |
| V | ON | OPEN (14) | DISENGAGED (15) | ENGAGED (15) |
| VI | ON | OPEN | DISENGAGED | ENGAGED |
| VII | ON | OPEN | DISENGAGED | ENGAGED |
| VIII | ON | OPEN | RELEASED (20) | RELEASED (20) |
| IX | OFF (23) | CLOSED (21) | ENGAGED (22) | DISENGAGED (22) |

Figure 3A:
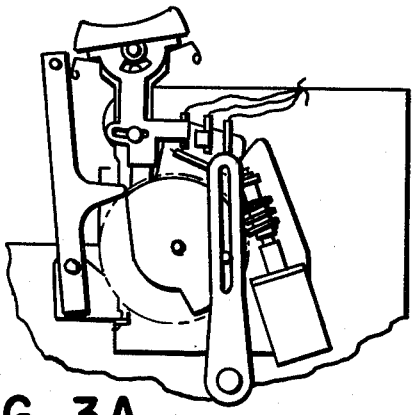
FIG. 3A is yet another end view of the control apparatus with the components thereof positioned or in a state for feeding the paper about the platen following an initial insertion operation.
Figure 3B:
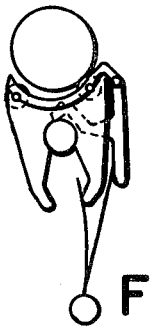
FIG. 3B is an end view illustrating the position of the comb for the component position or state shown in FIG. 3A.

In considering table A above, the components of the apparatus of this invention are in the position or state illustrated in FIGS. 2A and 2B when an initial loading operation is to take place. Each operational sequence of events is numbered in order in parenthesis in the table. The initial loading operation beings with a sheet of paper 71 being inserted into the printer from behind platen 68. Prior to insertion of the sheet of paper 71 into the printer, paper aligner 62 is to be in engagement with platen 68 and rear feed roller 61 is to be displaced from platen 68. Upon the insertion of sheet 71, the leading edge 73 thereof is aligned against aligner 62. Thereafter, end 33 of rocker button 31 is momentarily depressed. This results in the closing of reed switch 44 by magnet 41 and the turning on of motor 4. Rotation of motor 4 will effect clockwise rotation of comb 20 for translating rear roller 61 toward platen 68 for causing engagement of paper 71 and platen 68. Also, aligner 62 will be displaced or translated away from platen 68. Rotation of gear 8 continues until magnet 80, which is embedded in the back side of gear 8, is positioned for opening reed switch 43. The opening of reed switch 43 causes motor 4 to be turned off and signals to be applied along a number of lines 45 through 47 to a platen drive motor for rotating platen 68. Platen 68 is rotated a desired extent by a stepper motor, servo motor, etc., until leading edge 73 has been advanced sufficiently for the first line to be printed on sheet 71. The platen drive motor is then turned off and a signal or signals are applied along a number of lines 45 through 47 to again start drive motor 4. During the first time drive motor 4 was on, paper bail 74 connected to arm 22 was rotated in a counterclockwise direction about shaft 21 for translating paper bail 74 away from platen 68. When motor 4 is again turned on upon the stopping of rotation of platen 68, paper bail 74 is to be translated toward platen 68 for urging the leading end 81 of sheet 71 toward platen 68. The component position and state at the time platen 68 is rotated for advancing the leading end 81 to a first writing line position are as shown in FIGS. 3A and 3B. After motor 4 has stopped, the component position and state are to be as shown in FIGS. 2A and 2B for front roller feeding of sheet 71 upon rotation of platen 68 for printing.

Table B depicts the details of a paper release operation. For a paper release operation, the front feed roller 60 and rear feed roller 61 are to be out of engagement and away from platen 68. The apparatus component position and state are to be as shown in FIGS. 1A and 1B. The operational order of events is numbered in order in parenthesis in the table. One point to note is that when end 32 of button 31 is depressed, motor 4 is turned on for a predetermined time and then turned off. This is due to a signal or signals applied along a number of lines 45 through 47. This predetermined time or time out is supplied by logic (not shown) which forms no part of this invention. This is also the case for the logic (not shown) which controls the turning on of the platen drive motor to rotate the platen a desired extent, and in sequence again turning on motor 4.

In summary, an apparatus is provided for controlling paper aligning, rear roller feeding, front roller feeding and paper bail opening and closing in conjunction with the feeding of paper about a printer platen. The apparatus is primarily made up of an operator manipulatable rocker button, reed switches, a drive motor, a cam gear, a comb, and a paper bail arm for carrying a paper bail. When each of these components is in a position or state for paper to be loaded into the printer, the operator procedure is to insert a sheet of paper into the printer from behind the platen and align the leading edge of the sheet relative to a paper aligner. At this time, (1) a rear feed roller is located away from the platen to provide a paper path to the paper aligner, (2) the paper aligner is located in the path of the leading edge of the sheet, and (3) the paper bail is closed or located against the platen. Thereafter, momentary depression of the rocker button to a start position initiates a controlled operation of feeding paper about the platen to a first writing line position. Upon depression of the button, one of the reed switches is tripped by the rocker button and the drive motor is started. The drive motor is connected to the cam gear which effects rotation of the comb and the paper bail arm in a first direction. Rotation of the comb in the first direction causes the rear feed roller to be translated toward the platen and the paper aligner to be repositioned out of the path of the paper. Translation of the rear feed roller toward the platen is to effect engagement of the platen and paper for feeding the paper about the platen upon rotation of the platen. Repositioning of the paper aligner is to open the paper path about the platen. Rotation of the paper bail arm in a first direction results in the paper bail carried by the arm to be translated away from the platen.

Carried by the cam gear is a magnet which will eventually trip another reed switch upon continued rotation of the cam gear. When this occurs, the drive motor is turned off, and the platen is rotated for advancing the leading end of the paper beyond the paper aligner and a front feed roller to a first writing line position adjacent the paper bail. After the paper has been advanced to this extent, rotation of the platen is stopped and the drive motor is again turned on. This results in further rotation of the cam gear. During this further rotation, the comb is rotated in a second direction for translating the front feed roller toward the paper and causing engagement of the paper with the platen. Also, the paper aligner is permitted to restore and again engage the paper. Following this, the paper bail arm is rotated in a second direction for bringing the leading end of the paper toward and against the platen for printing on the sheet.

While the invention has been particularly shown and described with reference to a particular embodiment, it will be understood by those skilled in the art that various changes in form and detail may be made without departing from the spirit and scope of the invention.

What is claimed is:

1. Apparatus for controlling the feeding of paper about a printer platen, said apparatus comprising;
   (a) means operable for initiating a paper feeding cycle to position a sheet of paper about said platen for printing;
   (b) means for effecting front and rear roller feeding of said sheet and aligning said sheet;
   (c) cam means coupled to said effecting means for operating said effecting means;
   (d) drive means coupled to said cam means for operating said cam means; and
   (e) switch means coupled to said initiating means when operated for initiating a paper feeding cycle for starting said drive means.

2. Apparatus according to claim 1 wherein said printer includes a paper bail and said apparatus includes means for operating said paper bail.

3. Apparatus according to claim 2 wherein said paper bail operating means includes means for cooperating with said cam means for positioning said paper bail relative to said platen.

4. Apparatus according to claim 3 wherein said cam means includes means for operating said switch means for stopping said drive means.

5. Apparatus according to claim 4 wherein said printer includes platen drive means for rotating said platen and wherein said apparatus includes means coupling said switch means and said platen drive means for starting and stopping rotation of said platen.

6. Apparatus for controlling paper feeding in a printer having a rotatable platen, front and rear feed rollers, a paper aligner, and a paper bail, said apparatus comprising:
   (a) operator operable means for initiating a cycle involving a plurality of platen rotation, front roller feeding, rear roller feeding, paper aligning, paper bail opening and paper bail closing;
   (b) first rotatable means for effecting paper aligning, front roller feeding, and rear roller feeding;
   (c) second rotatable means for effecting paper bail opening and paper bail closing; and
   (d) switch means operable by said initiating means for causing rotation of said first and second rotatable means and said platen.

7. Apparatus according to claim 6 including drive means coupled to said switch means for rotating said first and second rotatable means.

8. Apparatus according to claim 7 including cam means coupled to said drive means and said first and second rotatable means for controlling the timing of rotation of said first and second rotatable means.

9. Apparatus according to claim 8 wherein said cam means includes means for operating said switch means.

10. Apparatus according to claim 9 wherein said initiating means includes means for effecting front and rear roller releasing.

* * * * *